US005081507A

United States Patent [19]

Monkelbaan et al.

[11] Patent Number: 5,081,507

[45] Date of Patent: Jan. 14, 1992

[54] REGISTRATION APPARATUS FOR A PRINTING SYSTEM

[75] Inventors: Edwin R. Monkelbaan, Fairport; Joseph Fantuzzo, Webster; Thomas Robson, Penfield; Herbert H. Ammenheuser, Henrietta, all of N.Y.

[73] Assignee: Xerox Corporation, Stamford, Conn.

[21] Appl. No.: 121,195

[22] Filed: Nov. 16, 1987

[51] Int. Cl.[5] ..... G03G 15/01; G03G 21/00

[52] U.S. Cl. ..... 355/309; 355/327

[58] Field of Search ..... 355/30 R, 3 TR, 4, 256, 355/308, 309, 326, 327; 354/340, 346, 347; 226/91, 92; 271/277; 352/235

[56] References Cited

U.S. PATENT DOCUMENTS

| | | | |
|---|---|---|---|
| 3,834,808 | 9/1974 | Takahashi et al. | 355/30 DR |
| 4,183,652 | 1/1980 | Yanagawa | 355/3 DR |
| 4,219,272 | 8/1980 | Bruckel et al. | 355/3 DR X |
| 4,298,278 | 11/1981 | Katakura et al. | 355/85 |
| 4,357,093 | 11/1982 | Caudill et al. | 355/3 DR X |
| 4,443,094 | 4/1984 | Ricciardi | 355/3 DR X |
| 4,459,913 | 7/1984 | Kowalik | 101/415.1 |
| 4,517,575 | 5/1985 | Kakimoto et al. | 355/3 DR X |
| 4,552,448 | 11/1985 | Davidson | 355/3 SH |
| 4,596,184 | 6/1986 | Fischer | 101/232 |
| 4,610,529 | 9/1986 | Koizumi | 355/4 |
| 4,707,123 | 11/1987 | Ueyama | 355/3 DR X |
| 4,740,813 | 4/1988 | Roy | 355/3 DR |

*Primary Examiner*—Fred L. Braun

*Attorney, Agent, or Firm*—H. Fleischer; J. E. Beck; R. Zibelli

[57] ABSTRACT

An apparatus in which a sheet is advanced into registration with different color information developed on master sheets secured releasably on different drums. Each master sheet is secured to a gripper bar having outwardly extending pins. The pins in the master sheet gripper bars mount in holes in the drum and extend outwardly therefrom. A chain driven gripper bar advances the sheet into registration with successive master sheets. The sheet gripper bar is mounted pivotably and slidably on the chain. The sheet gripper bar has notches in the leading edge thereof to mesh with the pins extending from the master sheet gripper bar. This detachably couples the sheet and the master sheet to move in unison with one another. In this way, the sheet is placed in registration with the different color information developed on each master sheet. After the color information is transferred from the master sheet to the sheet, the sheet gripper is decoupled from the pins and advances with the chain to place the sheet in registration with the next successive master sheet.

3 Claims, 6 Drawing Sheets

REGISTRATION APPARATUS FOR A PRINTING SYSTEM

This invention relates generally to a multicolor printing system, and more particularly concerns an apparatus for advancing a sheet into registration with master sheets secured releasably on different rotating drums.

There are different printing processes which employ a moving master for transferring an image to a sheet of paper. One such technique is used to produce multiple color proof copies from halftone film separations. Initially, an electrostatic master is exposed to a halftone film separation. This forms an electrostatic latent image on the master corresponding to the halftone film separation. Four masters are made. One of the masters corresponds to black with the other masters corresponding to single colors in the desired proof copy. The masters are then placed in the printing machine and secured to rotating cylinders. One master is mounted releasably on each cylinder. Each master is charged to a substantially uniform potential. The charge bleeds away except in the image areas to form an electrostatic latent image thereon corresponding to the image areas of the halftone film separation. The latent image is developed by bringing a liquid developer material into contact therewith. The liquid developer material comprises a liquid carrier having pigmented particles dispersed therein. The pigmented particles are deposited, in image configuration, on the master. These latent images are developed with developer material having a color corresponding to the subtractive primary of the color of the corresponding halftone film separation. Thereafter, the differently colored developed images are transferred from the masters to the sheet in superimposed registration with one another. Heat is then applied to permanently fuse the image to the sheet so as to form a color proof copy.

Hereinbefore developed images have been transferred to the copy sheet by an electrical field created by a corona generating device which induces transfer to the copy sheet by spraying a corona discharge having a polarity opposite to that of the developed image. This causes the developed image to be electrically transferred to the copy sheet. However, in transferring multiple developed images, the developed images must be in superimposed registration with one another in order to produce a color copy which is not blurred. Instead of using a corona generating device, an electrically biased transfer roll may be used. The electrically biased transfer roll generates a high voltage discharge in the proximity of the surface of the copy sheet, or it may be applied by a conductive cylinder in contact with the copy sheet. The copy sheet is interposed between the conductive roller and the photoconductive surface. A charge of opposite polarity from the developed image is deposited on the backside of the copy sheet which attracts the developed image thereto. In either case, the copy sheet must be advanced so that all of the developed images may be transferred thereto in registration with one another. Various approaches have been devised for moving the copy sheet, the following disclosures appear to be relevant:

U.S. Pat. No. 4,298,278
Patentee: Katakura et al.
Issued: Nov. 3, 1981

U.S. Pat. No. 4,459,913
Patentee: Kowalik
Issued: July 17, 1984

U.S. Pat. No. 4,552,448
Patentee: Davidson
Issued: Nov. 12, 1985

U.S. Pat. No. 4,596,184
Patentee: Fischer
Issued: June 24, 1986

The relevant portions of the foregoing disclosures may be briefly summarized as follows:

U.S. Pat. No. 4,298,278 discloses a device for detachably attaching a master sheet or photosensitive sheet to a printing drum. The master sheet has a hooking member at both edges thereof which are inserted along the surface of a fastening gate. A hooking hole, formed in the hooking member, is brought into agreement with a hole in the fastening plate. A fastening lever and pin are then used to secure the fastening plate along with the master sheet.

U.S. Pat. No. 4,459,913 describes a master sheet carrier which has a plate with a plurality of spiked posts for holding the tail end of the master.

U.S. Pat. No. 4,552,448 discloses a sheet gripper which transports a sheet in a recirculating path. The sheet gripper is detachably coupled to a photoconductive drum during transfer to place the copy sheet in registration with the toner powder image thereon. A pin on the sheet gripper mates with a hole in the drum to achieve registration. After transfer of the toner powder image from the photoconductive drum to the copy sheet, the gripper is decoupled from the photoconductive drum. Successive toner powder images are transferred to the sheet in superimposed registration with one another.

U.S. Pat. No. 4,596,184 describes an apparatus for transporting printed sheets. A sheet delivery drum has a sheet removal chain located adjacent to it. Cross elements carry a spaced gripper having gripper tongues engaging in gripper surfaces found on the engagement spindles. The tongues are rotatable with the gripper spindles to grip or release the leading edge of a sheet. A control cam follower roller controls the movement of the gripper tongue. The transport chain has chain bolts connecting bolts secured to the cross elements to transport the gripper device and the printed sheet.

In accordance with one aspect of the present invention, there is provided an apparatus for advancing a sheet into registration with different color information developed on master sheets secured releasably on different moving members. The apparatus include means for transporting the sheet. Means are provide for detachably coupling the transporting means to each of the master sheets. The transporting means is decoupled from the master sheets to move independently thereof and coupled to each of the master sheets in succession to move in unison therewith over a portion of the path of travel of each master sheet. In this way, the sheet is placed in registration with the different color information developed on each master sheet.

Pursuant to another aspect of the present invention, there is provided a printing machine of the type having different color liquid images developed on master sheets secured releasably on different moving members. A sheet is advanced into registration with the different color liquid images developed on the master sheets. The printing machine includes means for transporting the sheet. Means are provided for detachably coupling the transporting means to each of the master sheets. The transporting means is decoupled from the master sheets to move independently thereof and being coupled to each of the master sheets in succession to move in unison therewith over a portion of the path of travel of each master sheet. In this way, the sheet is placed in registration with the different color liquid images developed on each master sheet.

Other aspects of the present invention will become apparent as the following description proceeds and upon reference to the drawings, in which.

While the present invention will hereinafter be described in conjunction with various embodiments thereof, it will be understood that it is not intended to limit the invention to these embodiments. On the contrary, it is intended to cover all alternatives, modifications, and equivalents as may be included within the spirit and scope of the invention as defined by the appended claims.

Figure 1:
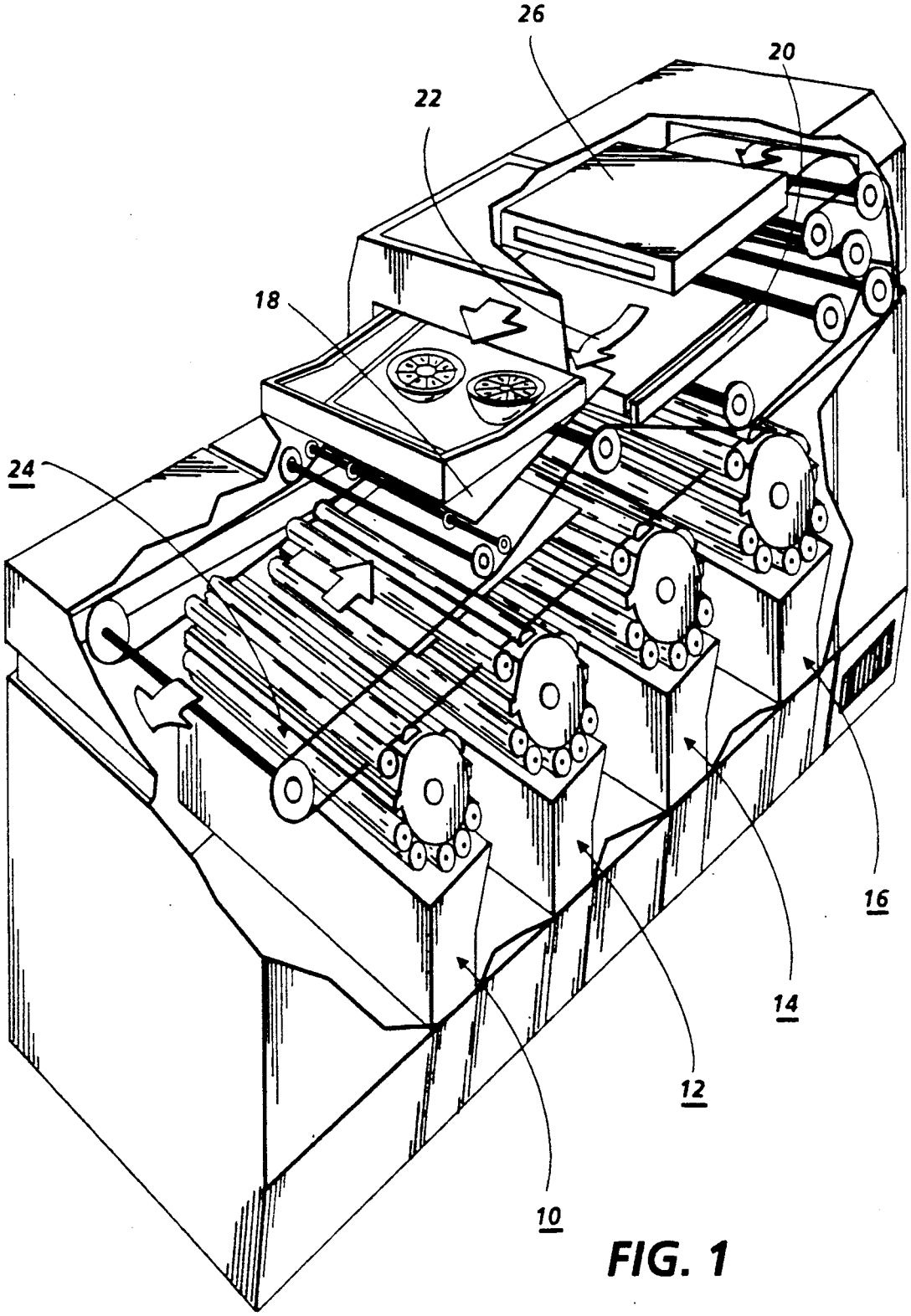
FIG. 1 is a schematic, perspective view showing an illustrative printing machine incorporating the features of the present invention therein.

Turning now to FIG. 1, the printing machine employs four printing modulus, indicated generally by the reference numerals 10, 12, 14, and 16. Each printing module is substantially identical to one another with the only distinction being the color of the developer material. Printing module 10 employs a yellow developer material, printing module 12 a magenta developer material, printing module 14 a cyan developer material, and printing module 16 a black developer material. In operation, a discrete master sheet is formed for each printing module. This is achieved by exposing the master sheet to a halftone film separation. The halftone film separation is a negative corresponding to a single color of the desired color proof. The master sheet has a photopolymer layer coated on a metallized base and protected with a thin cover sheet. One skilled in the art will appreciate that any other suitable master sheet may also be employed. A contact exposure is made through the halftone film with a high intensity ultraviolet light. In the image areas, the polymerized area of the master sheet becomes an insulator to electric charge. The unexposed polymer retains its conductive properties. After exposure, the cover sheet is removed from the master sheet. After the cover sheet is removed from each of the master sheets, the master sheets are taken to the printing machine and loaded onto the drum of the appropriate printing module. Further details of the method and apparatus associated with loading master sheets on the drums of the respective printing modules will be described hereinafter with reference to FIGS. 6 and 7.

With continued reference to FIG. 1, after the master sheets are loaded in their respective printing modules, the printing machine is actuated to print the color proof. Upon energization of the printing machine, a sheet of support material 18 is advanced from tray 20. The sheet of support material may be made from any suitable material, e.g. plain paper. A sheet feeder separates and advances the uppermost sheet from a stack of sheets in tray 20. The sheet moves in the direction of arrow 22 to a transport, indicated generally by the reference numeral 24. Further details of transport 24 will be described hereinafter with reference to FIGS. 3 through 5, inclusive. Transport 24 advances the sheet to successive printing modules. The master sheet, in each printing module, is developed with a different color liquid developer material. The differently colored developed images on each master sheet are transferred to sheet 18 in superimposed registration with one another to form a multicolor image thereon, Inasmuch as the printing modules are substantially identical to one another, only printing module 10 will be described in detail hereinafter with reference to FIG. 2. After all of the developed images have been transferred to sheet 18, transport 24 advances sheet 18 through fuser 26. Fuser 26 radiantly heats the sheet having the liquid images transferred thereto. The fuser supplies sufficient heat to dry and permanently affix the transferred image to sheet 18 forming the desired color proof. After fusing, the completed color proof is advanced to a tray for subsequent removal from the printing machine by the operator.

Figure 2:
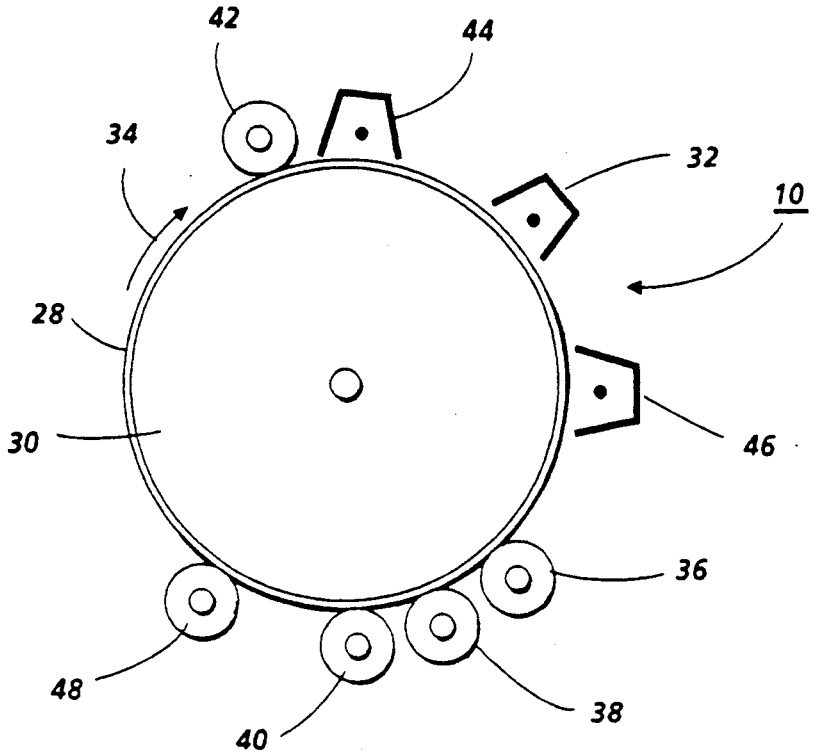
FIG. 2 is a schematic elevational view depicting one of the printing modulus used in the FIG. 1 printing machine.

Turning now to FIG. 2, there is shown further details of printing module 10. As shown thereat, a master sheet 28 is secured releasably to drum 30. During the first cycle, a corona generating device, indicated generally by the reference numeral 32, charges the master sheet 28 to a relatively high, substantially uniform potential. As drum 30 rotates master sheet 28 in the direction of arrow 34, the charge bleeds away from the master sheet, except in the image areas thereof. Next, developer rolls 36 and 38 advance yellow liquid developer material into contact with master sheet 28. The yellow liquid developer includes a clear carrier and yellow colored toner. In this way, liquid developer material is brought into contact with the latent image formed on the master sheet. The toner is attracted electrostatically to the image areas forming a yellow image on master sheet 28. Preferably, the developer material includes a clear liquid insulating carrier having pigmented particles, i.e. toner particles dispersed therein. A suitable clear insulating liquid carrier may be made from aliphatic hydrocarbon, such as an Isopar, which is a trademark of the Exxon Corporation, having a low boiling point. The toner particles include a pigment associated with a polymer. A suitable liquid developer material is described in U.S. Pat. No. 4,582,774, issued to Landa in 1986, the relevant portions thereof being incorporated into the present application. Metering roll 40 controls the quantity of developer material deposited on master sheet 28 and removes the excess therefrom. After the latent image on master sheet 28 is developed, drum 30 rotates the developed image to electrically biased roll 42 and corona generator 44. Sheet 18 is interposed between master sheet 28 and roll 42. Transport 44 interposes sheet 18 between corona generator 44 and master sheet 28. Roll 42 is electrically biased to a suitable magnitude and polarity to tack sheet 18 to master sheet 28. Corona generator 44 sprays onto the backside of sheet 18 to attract the developed image from master sheet 28 thereto. After the developed image has been transferred to sheet 18, the master sheet passes through the next cycle, i.e. a cleaning cycle, and sheet 18 advances to the next printing module. During the first cycle, corona generator 46 and cleaning roll 48 are non-operative. In contradistinction, corona generator 46 and cleaning roll 48 are operative during this cleaning cycle with corona generators 32 and 44, developer rolls 36 and 38, and metering roll 40 being non-operative. Corona generator 46 sprays ions onto master sheet 28 to neutralize the charge thereon. Cleaning roller 48 scrubs the surface of master sheet 28 clean. To assist in this action, liquid carrier may be fed onto the surface of cleaning roller 48. Preferably, the cleaning fluid is the carrier of the liquid developer material, i.e. a clear low boiling point aliphatic hydrocarbon, such as an Isopar, which is a trademark of the Exxon Corporation.

It is believed that the foregoing description is sufficient for purposes of the present application to illustrate the general operation of a printing machine incorporating the features of the present invention therein.

Figure 3:
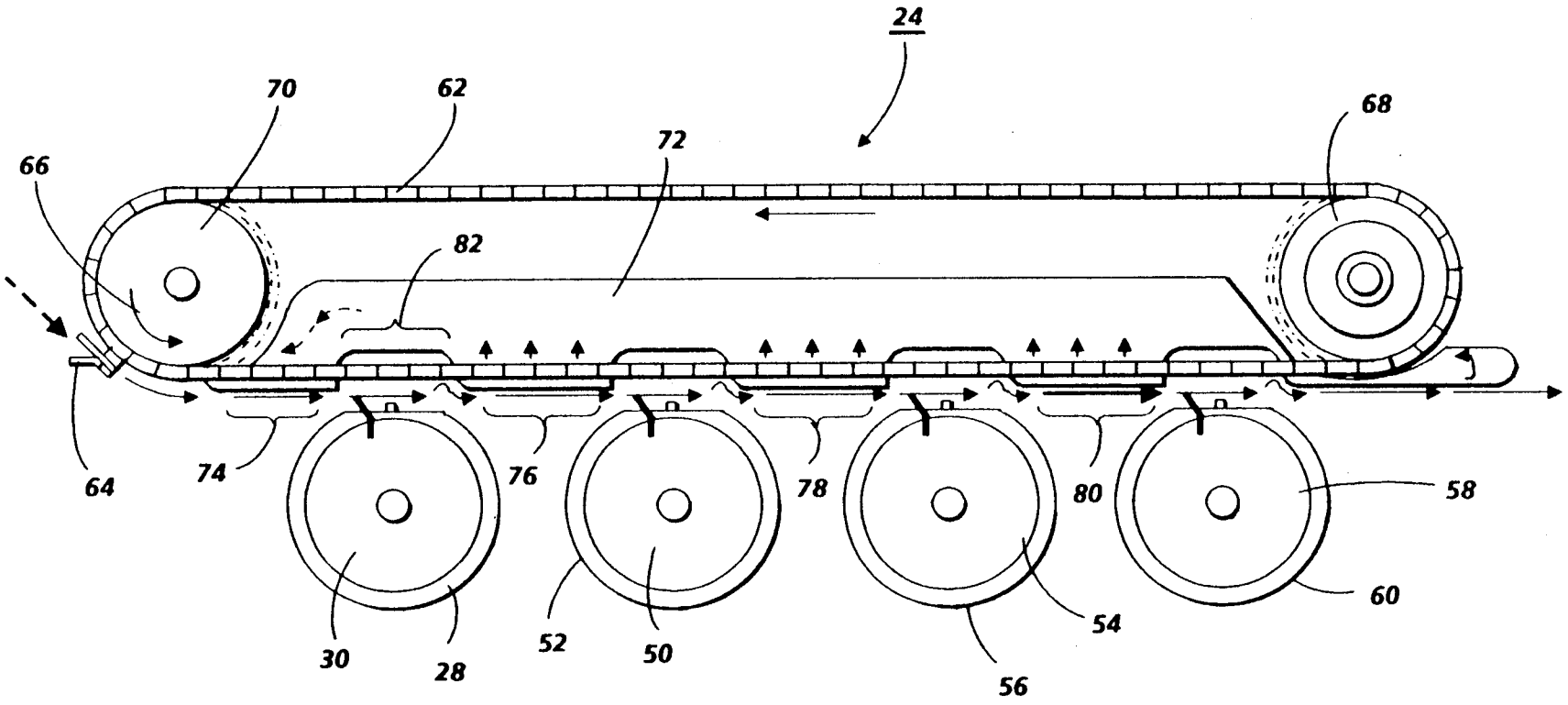
FIG. 3 is a schematic, elevational view illustrating one embodiment of a transport used in the FIG. 1 printing machine.

Referring now to FIG. 3, there is shown one embodiment of transport 24 in greater detail. As illustrated thereat, transport 24 advances sheet 18 to successive printing modules. Each of the printing modules is substantially identical with the only distinction being the color of the liquid developer material contained therein. Printing module 10 includes drum 30 having master sheet 28 secured releasably thereon. Printing module 12 includes drum 50 having master sheet 52 secured releasably thereon. Printing module 14 includes drum 54 having master sheet 56 secured releasably thereon. Printing module 16 includes drum 58 having master sheet 60 secured releasably thereon. A pair of parallel, spaced chains 62 entrained about spaced sprockets 68 and 70 advance a gripper 64 in a recirculating path. A servo motor (not shown) coupled to sprocket 68 rotates the sprocket to advance chains 62 in the direction of arrow 66. Gripper bar 64 moves with chains 62 to transport sheet 18 to master sheets 28, 52, 56, and 60. A vacuum plenum 72 is positioned interiorly of chains 62 and supports sheet 18 between successive master sheets in vacuum zones 74, 76, 78 and 80. Transport 24 advances gripper bar 64 to drum 30. Gripper bar 64 is secured releasably on drum 30. Electrically biased roll 42 (FIG. 2) then tacks sheet 18 to master sheet 28 on drum 30. In transfer zone 82, corona generator 44 (FIG. 2) attracts the developed image from master sheet 28 to sheet 18. As sheet 18 exits transfer zone 82, gripper bar 64 is released from drum 30 and the speed of transport 24 is reduced. A cam (not shown) pulls gripper 64 in a 90° direction with respect to drum 30 thereby pealing sheet 18 from master sheet 28 and forming a buckle. The buckle, after transfer, prevents interference with smooth transfer, i.e. the buckle will prevent disturbing the image by any perturbations in the accuracy of transporting sheet 18 to the next master sheet 52. As gripper bar 64 moves with transport 24 toward drum 50, sheet 18 is supported in vacuum zone 76 by the vacuum produced by vacuum plenum 72. When gripper bar 64 reaches drum 50, the procedure previously described from drum 30 is repeated and a magenta image is transferred to sheet 18 in superimposed registration with the yellow image previously transferred thereto from master sheet 28. This procedure is repeated for drums 54 and 58 to effect the transfer of the cyan and black images to sheet 18. All of the images are transferred to sheet 18 in superimposed registration with one another. All four color images are registered to within a 0.0075 centimeters. After the last images is transferred to sheet 18, the upper portion (not shown) of transport 24 advances sheet 18 to fuser 25 (FIG. 1) where the sheet is dried and the image permanently fused thereto.

Figure 4:
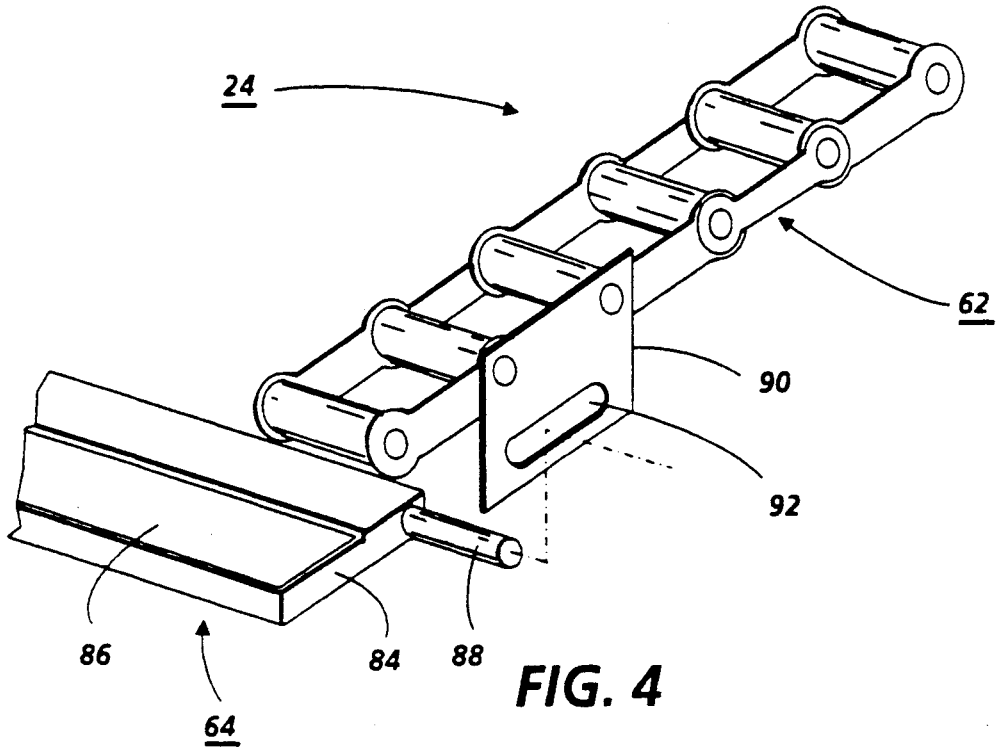
FIG. 4 is a fragmentary, perspective view showing a portion of the chain and gripper bar used in the FIG. 3 transport.

Turning now to FIG. 4, there is shown the detailed manner in which gripper bar 64 is secured to chains 62 of transport 24. As shown in FIG. 4, gripper bar 64 includes a support plate 84 having a gripper plate 86 mounted pivotably thereon. Gripper plate 86 is made from a magnetically attractable material. A plurality of spaced magnets are mounted on support plate 84 and attract gripper plate 86 to the closed position. Electromagnets are located at the exit and entrance zones, i.e. where sheet 18 is received and discharged from gripper bar 64. When the gripper bar passes these zones, the electromagnet is energized and the magnetic field generated thereby pivots gripper plate 86 to the open position for receiving and discharging sheet 18. Pins 88 extend outwardly from the ends of support plate 86. A bracket 90 having a slot 92 therein, is mounted on chain 62. Another bracket with a slot is also mounted on the other chain. Pins 88 are mounted slidably in slots 92 to provide a pivotable and slidable support for gripper bar 64. In this way, gripper bar 64 moves with chains 62 while being capable of pivoting and translating independently thereof during attachment to each of the drums of the printing modules.

Figure 5:
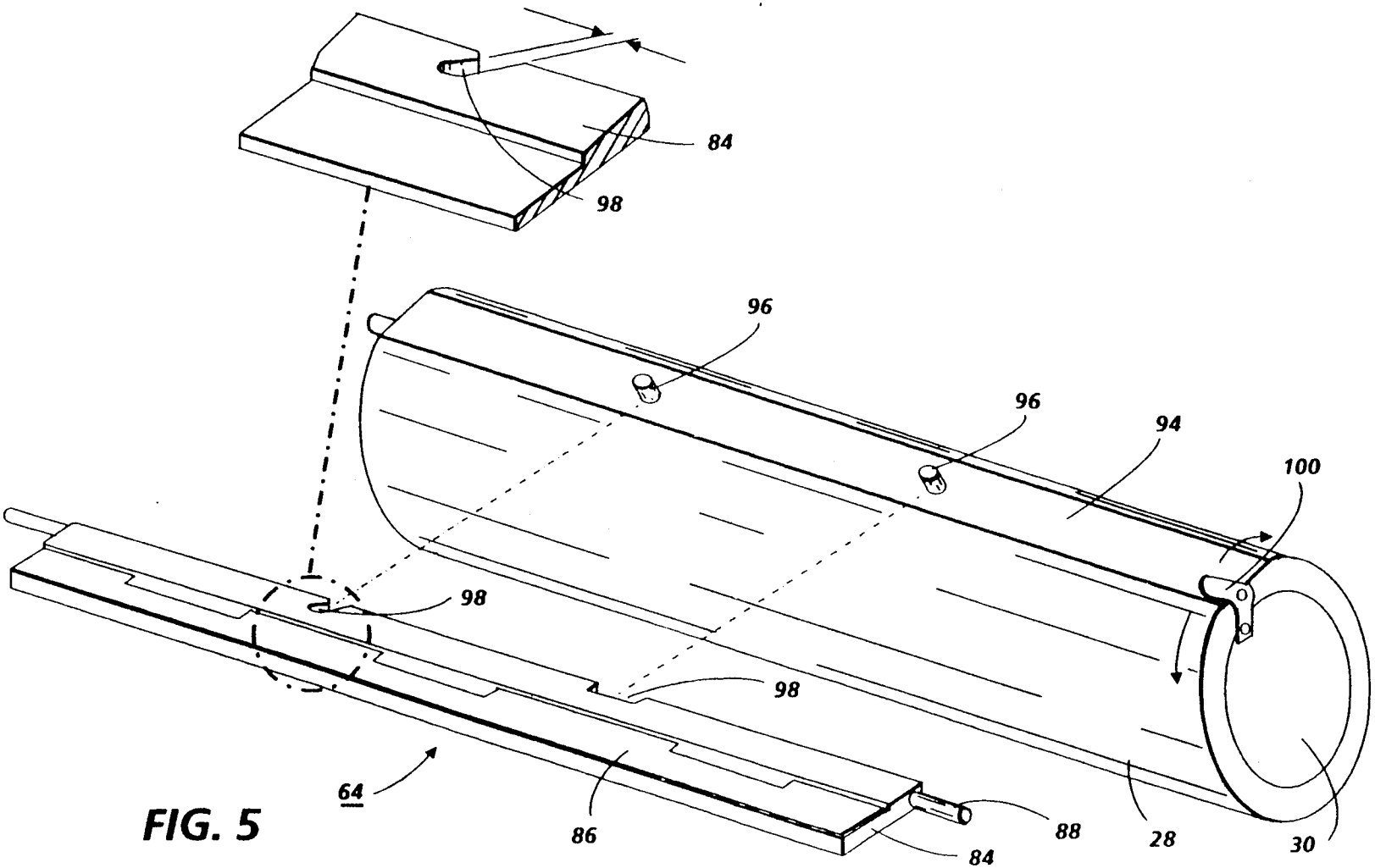
FIG. 5 is a fragmentary, perspective view depicting registration of the sheet with the master secured on the drum.

FIG. 5 illustrates the manner in which the gripper bar is attached releasably to a drum in registration with the master sheet secured thereon. This registration technique will only be described for master sheet 28 inasmuch as it identical for the other master sheets used in the printing machine. Master sheet 28 is attached releasably to registration plate 94. The manner of attaching master sheet 28 to registration plate 94 will be described hereinafter with respect to FIG. 7. Master sheet 28 is attached to registration plate 94 at a predetermined position relative to registration pins 96 mounted fixedly on and extending outwardly from plate 94. Support plate 84 has notches 98 formed in the edge thereof. Notches 98 are sized to mate with registration pins 96, i.e. the width of the notch is substantially equal to the diameter of registration pin 96. Transport 24 advances gripper bar 64 so that notches 98 mesh with registration pins 96. Locking arm 100 is mounted pivotably on drum 30. When gripper bar 64 is positioned so that notch 98 meshes with registration pins 96, a solenoid pivots locking arm 100 from the open position to the closed position. In the open position, locking arm 100 receives pin 88 of support plate 84. When locking arm 100 pivots to the closed position, it clamps pin 88 to secure plate 100 in the registration position with notches 98 meshing with registration pins 96. This places sheet 18 in registration with master sheet 28.

Figure 6:
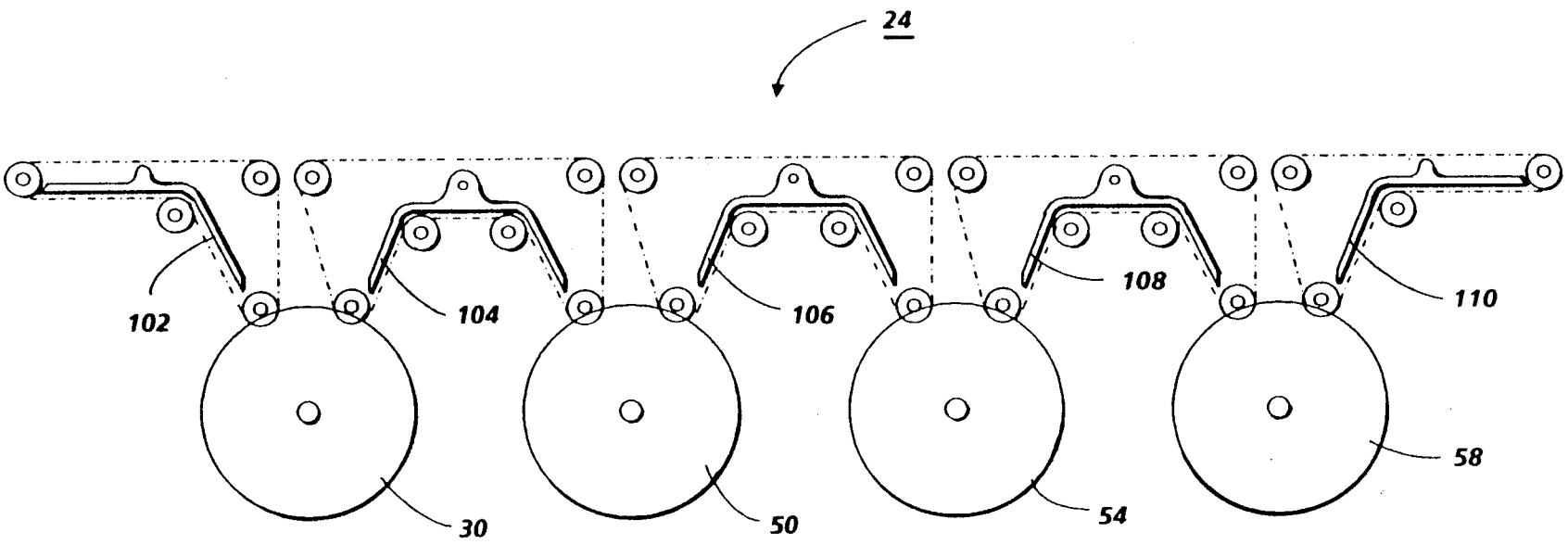
FIG. 6 is a schematic, elevational view illustrating another embodiment of a transport used in the FIG. 1 printing machine.

Referring now to FIG. 6, there is shown another embodiment of transport 24. In this embodiment, transport 24 includes a plurality of pairs of chain loops 102, 104, 106, 108, and 110. The chain loops of each pair is spaced from one another to define a support for the registration plate. The master sheets from drums 30, 50, 54, and 58 are attached to their respective registration plates. The first master sheet and its associated registration plate are secured releasably to chain loop 102. Chain loop 102 transports the registration plate and master sheet to drum 30. Drum 30 locates and clamps the registration plate thereto and the registration plate is released from the chain loop. The master sheet then wraps about the outer circumferential surface of the drum. This sequence is repeated for all of the master sheets and their respective drums. Master sheets 50, 54, and 58 are transported by the chain loops and handed off from one chain loop to the next until the registration plate and master arrive at the proper drum. This same chain loops may be used to transport gripper bar 64 having sheet 18 secured releasably thereto, to successive master sheets for transferring the developed image thereto. Thus, chain loop pairs 102, 104, 106, 108, and 110 may be used to automatically advanced the master sheet to its respective drum and to transport the sheet to successive master sheets for transferring the different colored images thereto in superimposed registration with one another.

Figure 7:
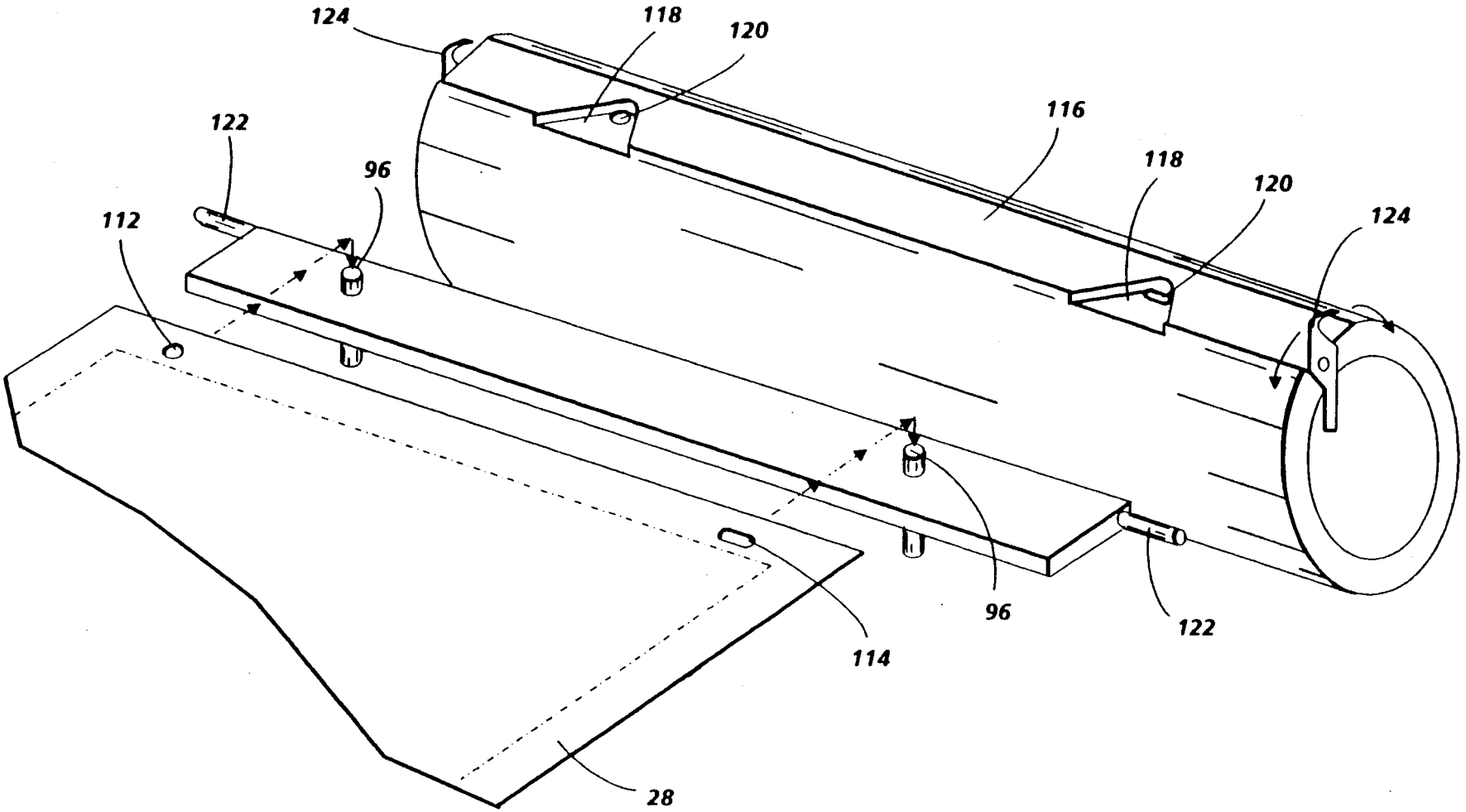
FIG. 7 is a fragmentary, perspective view showing the attachment of a master sheet to a drum.

FIG. 7 illustrates the manner in which the master sheets are secured releasably to the drums. Only the attachment of master sheet 28 to drum 30 will be described inasmuch as it is identical for the other drums and master sheets. Master sheet 28 has spaced holes 112 and 114 in the leading edge thereof. When the contact exposure is made through the halftone film separation, master sheet 28 is mounted on pins passing though holes 112 and 114. In this manner, the electrostatic latent image is recorded on the master sheet at a predetermined location with respect to holes 112 and 114. Registration plate 94 has registration pin 96 mounted thereon and extending therethrough. Master sheet 28 is manually mounted on registration plate 94 by placing registration pins 96 in holes 112 and 114. This defines the location of the electrostatic latent image on master sheet 28 relative to registration pins 96 on registration plate 94. Transport 24 advances registration plate 94 with master sheet 28 secured thereto onto drum 30. Drum 30 has a flattened region 116 with a pair of spaced triangular notches 118 having holes 120 at the apexes thereof. Registration plate 94 has mounting pins 122 extending outwardly from opposed sides thereof. Transport 24 moves registration plate 94 onto drum 30 with registration pins 96 being guided by triangular notches 118 into holes 120. Registration plate 94 is then released from the chains of transport 24 and locking arms 124 are actuated. Locking arms 124 are mounted pivotably on opposed ends of drum 30. Solenoid actuated locking arms 124 clamp onto mounting pins 122 holding registration pins 96 in holes 120 in drum 30. As previously discussed with reference to FIG. 4, gripper bar 64 has notches therein which mesh with registration pins 96. In this manner, the electrostatic latent image recorded on master sheet 18 is positioned in precise registration with a selected region of sheet 18. This enables successive developed images to be transferred in superimposed registration with one another forming a multicolor image on sheet 18 resulting in the desired color proof.

In recapitulation, it is clear that the transport apparatus of the present invention advances a sheet to successive master sheet and registers the sheet therewith to insure the transfer of different color images thereto in superimposed registration with one another. In addition, the transport apparatus is also capable of advancing successive master sheets to their respective drums for mounting automatically thereon.

It is, therefore, evident that has been provided in accordance with the present invention, a transport apparatus that fully satisfies the aims and advantages heretofore mentioned. While this invention has been described in conjunction with various embodiments, it is evident that many alternatives, modifications and variations will be apparent to those skilled in the art. Accordingly, it is intended to embrace all such alternatives, modifications and variations that fall within the spirit and broad scope of the appended claims.

We claim:

1. A printing machine of the type having a plurality of master sheets with each master sheet being secured releasably on a different moving drums and having a different color liquid image developed thereon, wherein the improvement includes:

means for transporting a sheet to each one of the master sheets, said transporting means includes a sheet gripper, and means for advancing said sheet gripper in a recirculating path of movement wherein the sheet secured to said sheet gripper is advanced to each of the master sheets in registration with the different color liquid images developed thereon;

means for detachably coupling said transporting means to each one of the master sheets, said transporting means being decoupled from each one of the master sheets to move independently thereof and being coupled to each of the master sheets in succession to move in unison therewith over a portion of the path of travel of each master sheet to place the sheet in registration with the color liquid images developed on the master sheets, said coupling means includes at least one protuberance extending outwardly from each of the moving members, and at least one notch in said sheet gripper adapted to mesh with said protuberance, means for transferring the different color liquid images from the master sheets to the sheet in registration with one another to form a multicolor print; and a plurality of master grippers with one of said plurality of master grippers being adapted to be advanced to each of said drums.

2. A printing machine according to claim 1, wherein said protuberance is mounted on each one of said plurality of master grippers.

3. A printing machine according to claim 2, wherein said drum includes at least one recess adapted to mesh with said protuberance.

* * * * *